United States Patent [19]

Schmit

[11] 4,076,147

[45] Feb. 28, 1978

[54] LIQUID CONTAINER HAVING A PLASTIC FILM POUCH AND A PIERCING ELEMENT TO OPEN THE PLASTIC FILM POUCH

[76] Inventor: Justin M. Schmit, 126 Sea Island Lane, Boca Raton, Fla. 33432

[21] Appl. No.: 683,174

[22] Filed: May 4, 1976

[51] Int. Cl.[2] ..... B67B 7/26

[52] U.S. Cl. ..... 222/89; 222/105; 222/183; 229/14 B

[58] Field of Search ..... 222/81, 83, 83.5, 88, 222/89, 183, 105, 107, 569; 224/14 B

[56] References Cited

U.S. PATENT DOCUMENTS

| | | | |
|---|---|---|---|
| 2,374,796 | 5/1945 | Amberg | 222/107 |
| 2,454,919 | 11/1948 | Hagan | 222/105 X |
| 2,861,718 | 11/1958 | Winzen | 222/107 X |
| 3,128,913 | 4/1964 | Specketer | 222/107 |
| 3,938,707 | 2/1976 | Schmit | 222/88 X |

*Primary Examiner*—Drayton E. Hoffman
*Assistant Examiner*—Fred A. Silverberg
*Attorney, Agent, or Firm*—Schroeder, Siegfried, Ryan, Vidas and Steffey

[57] ABSTRACT

An improved container in which the container is formed of a plastic film pouch with a tubular member in one end of the same and positioned within a paper carton and secured thereto. The pouch is filled through the opening in the tubular member which projects through an aperture in the paper container. The tubular member is held to the surface of the container through a locking member and a sleeve member. A projecting portion of the sleeve member is threaded to receive a cap for sealing the container.

10 Claims, 16 Drawing Figures

LIQUID CONTAINER HAVING A PLASTIC FILM POUCH AND A PIERCING ELEMENT TO OPEN THE PLASTIC FILM POUCH

My invention relates to a container for holding and dispensing fluids and more particularly to an improved container construction and the method and machinery for making the same.

The improved container of the present invention utilizes a paper carton with an inserted plastic or pliant pouch for containing the fluid. Such components are generally old, and the concept of utilizing a plastic lined container for holding and dispensing of fluids is also recognized as old.

The present invention is directed to an improved container of this type in which the pouch is inserted into the carton as it is formed with the pouch attached to the carton such that the fluids may be readily dispensed from the carton. Such an improved container construction minimizes significantly the possibility of leakage over conventional plastic pouches or pouch lined cartons previously used. In addition, the invention includes the improved method for forming the pouch and the carton and inserting the pouch within the carton during the construction of the same. Further, the invention includes an improved machine for inserting the formed pouch into a carton and securing the same thereto.

Therefore, it is the principle object of this invention to provide an improved method and machine for forming a plastic pouch filled carton.

Another object of this invention is to provide an improved container or carton including a plastic pouch within the carton and fastened to the carton.

Another object of this invention is to provide an improved method of inserting a pouch into the carton.

A still further object of this invention is to provide an improved method of securing the pouch to the carton to insure filling of the same and to insure against leakage.

A still further object of this invention is to provide an improved machine for inserting a pouch into a carton and for fastening the pouch to the carton.

These and other objects of the invention will become apparent from the reading of the attached description together with the drawings wherein:

FIG. 1*a* is a schematic plan view of discs used in the initial step of forming the pouch;

FIG. 1*b* is a sectional view of the same;

FIG. 1*c* is a view similar to FIG. 1*b* showing the insertion of a locking ring on the pouch;

My improved container is formed by initially constructing a pouch for the same which, as indicated in FIGS. 1*a*, 1*b*, and 1*c*, and FIG. 2, starts with a sheet or film of plastic material, indicated generally at 10, which sheet or film has a tubular member 12 inserted through a closed edge thereof to deform the plastic material around the tubular member 12. The tubular member is preferably made of a plastic material and the plastic film sheet is an elongated rectangular size which when folded upon itself will define a folded side and three unseamed sides in the formation of a pouch 15 with the tubular member 12, inserted in the folded side. When folded, the film sheets will bear a relationship to the carton in which they are to be inserted such that the width of the sheet will be substantially equal to twice the width of the side of the carton and the length will be greater than the height of the interior of the carton with the end flaps at the top and bottom closed.

Figure 1A:
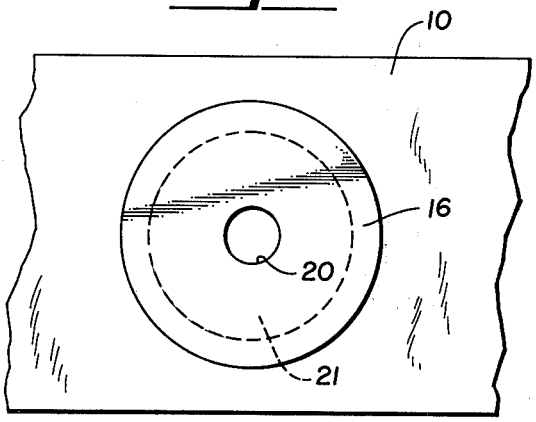
Figure 2:
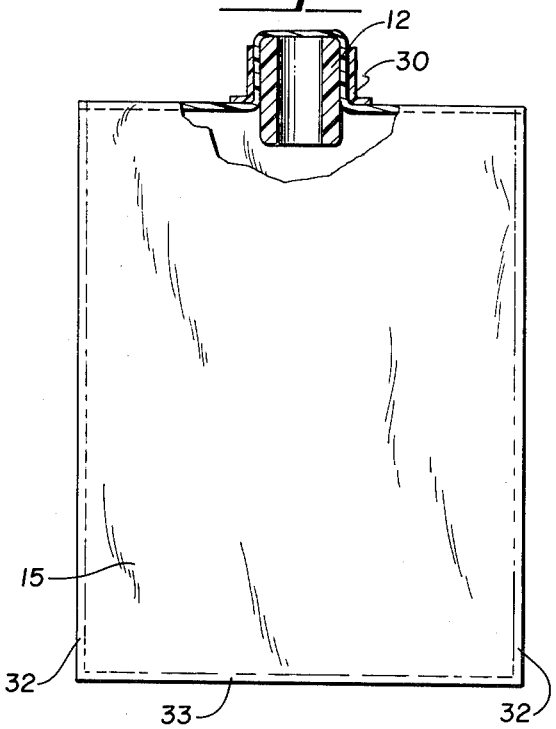
FIG. 2 is a schematic view showing the completion of the pouch.
Figure 1B:
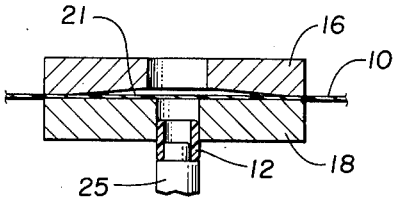
Figure 1C:
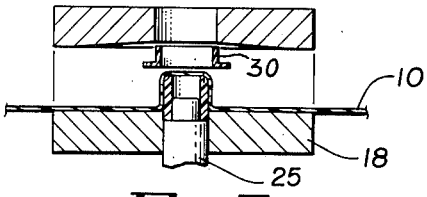

The tubular member is inserted into the film sheet in the location of the folded side when the pouch is assembled. As seen in FIGS. 1*a* and 1*b*, during the insertion of the tubular member 12, the film sheet 10 is placed flat and held in position between two disc-like members 16 and 18 having apertures 20 therethrough with the disc-like member 16 having an inner dished or sloped side as indicated at 21. The tubular member 12 in the assembly is inserted into the aperture 20 in the lower disc member 18 and a solid mandrel 25 is positioned below the same with the film sheet 10 positioned between the members 16, 18 and the members held in contacting relationship. The mandrel 25 is raised, stretching the film sheet in the area of the dished surface 21, and causing the tubular member to enter the aperture 20 in the upper disc 16 with the plastic film deforming around the tubular member. The tubular member has an external taper being largest at the uncovered end. A locking ring clamps the deformed film around the end of the tubular member 12. Locking ring 30 is positioned between the members 16, 18, and movement of the member 18 with the ring forces the ring over the tubular member. The ring has an internal taper and is swaged onto the tubular member with the film thereon intermediate the length of the tubular member. With this arrangement the film is deformed around the upper end of the tubular member 12 with the lower end of the tubular member extending beyond the surface of the film sheet. The discs 16 and 18 are then separated and the film sheet 10 folded on itself, as seen in FIG. 2, with the tubular member 12 centrally located on the folded side. The edges of the sheet around the same are heat sealed as at 32 and 33 to define the sealed bottom and sides of the pouch respectively.

Figure 3:
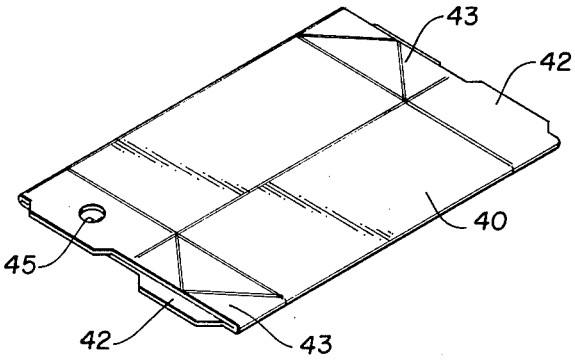
FIG. 3 is a perspective view of a carton in an unerected condition.
Figure 4:
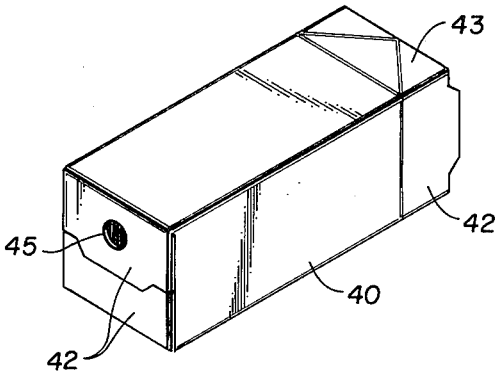
FIG. 4 is a perspective view of a carton in a partially erected position with the bottom open.
Figure 5:
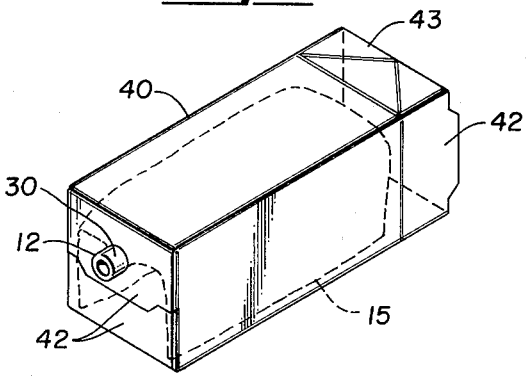
FIG. 5 is a perspective view of a carton with the pouch inserted therein.
Figure 6:
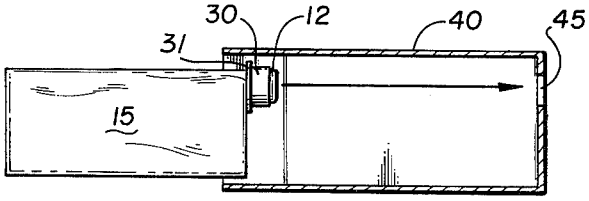
FIG. 6 is a schematic view showing the loading of a pouch into a carton in the assembly of the same.

The pouch so formed is adapted to be inserted into the paper carton 40 which is generally conventional and is preferably of a rectangular or square cross section having a height dimension greater than the width of the sides. The carton, as seen in FIG. 3, is normally cut from a sheet of relatively rigid paper material which is creased to define the sides and flaps with fold lines and glued at one side to be flat in an unerected condition. When the sides are folded to a squared relationship and the flaps at one end folded or sealed together, a partially erected carton is obtained as seen in FIG. 4. The flaps 42, 43 themselves define both top and bottom sides of the carton. As indicated in FIG. 3, the flattened carton will be constructed with an aperture 45 in one of the flaps defining the top wall of the carton which will preferably be located off center so that when the flaps are folded, the aperture will be provided through only a single thickness of carton material. Depending upon carton construction the aperture may pass through two or more flap thicknesses. The carton is erected in a conventional manner by displacing the same from a flattened condition to rectangular cross section and in-folding the flaps 42, 43 to form the top wall of the carton. The flaps are sealed to one another so that a flat surface defining the top wall of the carton is provided with an aperture therethrough. The bottom flaps are left open and, as indicated in FIG. 5, the pouch when empty will be positioned in the carton 40 in a "U" shaped configuration with the tubular member 12 having the locking ring 30 surrounding the same and the stretched film of plastic over the same projecting through the aperture 45 at the end of the carton. In this arrangement, the pouch width will be approximately equal to twice the side width of the carton and the length of the pouch will be greater than the internal length of the carton so that when inflated or filled will be drawn up to equal substantially the internal height dimension of the carton.

The pouch 15 is positioned within the carton 40 with the tubular member 12 projecting through the aperture 45 in the end of the carton and with the locking ring 30 positioned partially through the aperture with a portion 31 bearing against the inner surface of the top wall of the carton. The sides of the pouch will be folded within the carton to a generally "U" shaped configuration as shown in phantom in FIG. 5. Since the aperture 45 is slightly offset in the carton, the pouch will contact substantially with three sides of the carton in its initially positioning therein. Depending upon the machine for inserting the pouch within the carton, the configuration or drape of the pouch may be "V" shaped contacting two walls of the carton with the aperture 45 offset toward one corner of the top of the carton. For the purpose of the present disclosure, the apparatus shown in FIGS. 7 and 8 drape the pouch as shown in FIG. 5.

Figure 7:
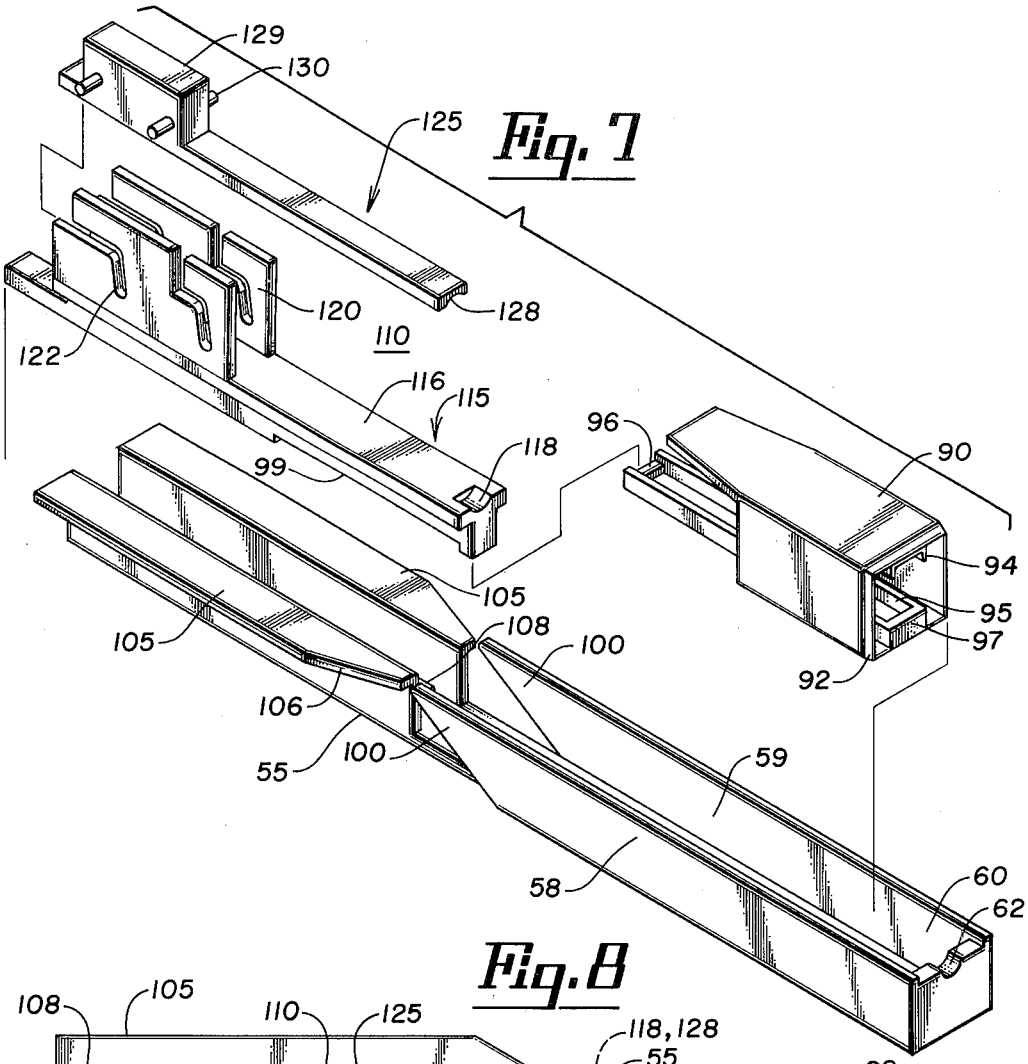
FIG. 7 is an exploded view of a machine for inserting a pouch into the carton.
Figure 8:
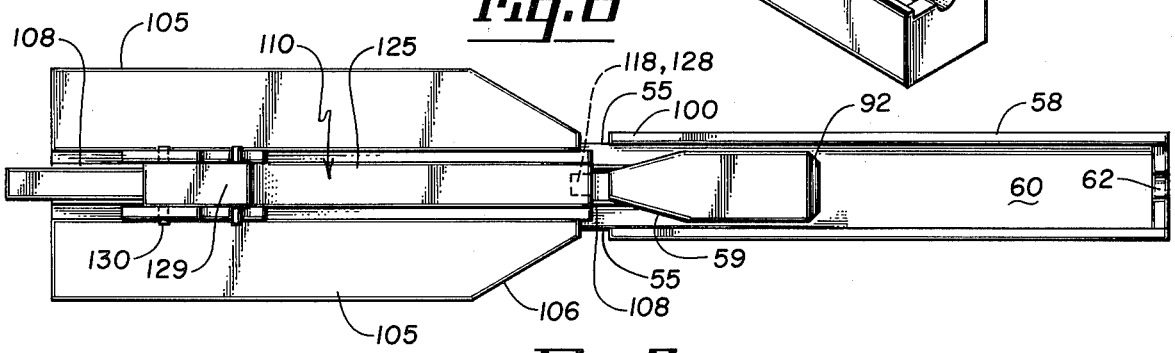
FIG. 8 is a plan view of the machine of FIG. 7.

Thus, in FIGS. 7 and 8, there is shown an apparatus or machine, indicated generally at 50, comprising an elongated frame 55 with the raised guides 58 defining a guide way 59 which at one end defines the carton holder position 60. This frame has a suitable notch or groove 62 at this end which is aligned with the aperture 45 of the carton when the carton is so positioned therein. The closed end of the carton abutts the end of the frame 55 with the recess 62 therein with the open flaps 42, 43 of the carton positioned at the opposite end of the carton holding position. The groove or notch 62 is semicylindrical in shape and is designed to hold a sleeve member 80 which is to be positioned on the exposed portion 31 of the locking ring 30 of the pouch when it is located within the carton. Sleeve members 80 may be automatically deposited into the recess 62 or manually inserted therein in the formation of the container. Similarly, the individual cartons may be automatically inserted and removed from the carton holding position 60 of the machine or manually positioned and removed.

Figure 11:
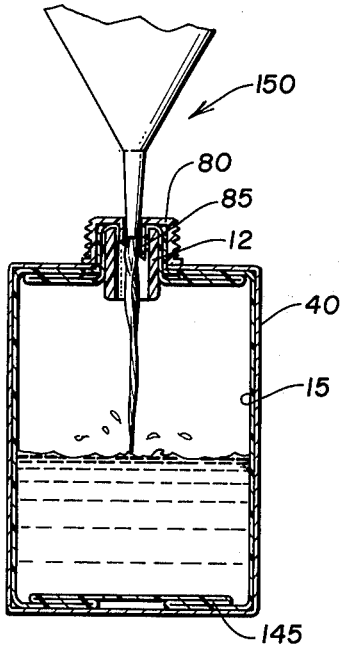
FIG. 11 is a schematic view showing the filling of the pouch positioned within a carton.

Slidably mounted in the recess 60 of the frame is a shaping mechanism or carton shaper in the form of a box-like sleeve member 90 which has rounded corners 92 at the front end of the same and upper and lower guide rails 94, 95 positioned therein with the shaping mechanism being open at both extremities. As will be hereinafter noted, the carton shaping mechanism will receive the pouch 15 and will slide into the carton 40 to guide the pouch and in particular, the tubular member 12 with the locking ring 30 thereon through the aperture 45 at the end of the carton maintaining the erected condition of the carton during the inserting operation. Mounted on the sides of the frame adjacent the rest position on the guide or shaping mechanism are a pair of plow members 100 which, as will be later noted, will receive the end of the pouch as it is advanced into the shaping mechanism and cause the same to effect the draped shape by turning the edges down. The end of the frame remote from the carton holder position 60 has a pair of translationally extending guide member 105 forming a guide section extending, translationally from a recessed rail surface 108 in the bottom of the frame. The guide section 105 is tapered at the end as at 106 to allow for bending over of the pouch sides to the "U" shaped draped configuration. Positioned in this end of the frame is the pouch gripping mechanism, indicated generally at 110, which includes a lower gripping member 115 adapted to slide through the recessed rail surface 108 and between the guide members 105. This lower gripping section has an upper flat surface 116 with a grooved recess 118 at the forward end of the same. Near the rear of the lower gripping member are raised flange sections 120 which have slotted cam surfaces 122 therein and which are located on either side of the lower gripping member. Cooperating with the lower gripping member is an upper gripping member 125 which includes an elongated flat surface with a recess 128 at one end of the same cooperating with the recess 118 in the lower gripping member and having a raised section 129 with suitable cam followers or pins 130 riding in the recesses grooves 122 in the flange or section 120 of member 115. Thus, the upper gripping member 125 may be moved relative to the lower gripping member along the cam surfaces through movement of the pins 130 in the cam surfaces 122 to raise the upper gripping member 125 relative to the lowering gripping member and to separate the members so that a pouch may be inserted therebetween. By movement of the upper gripping member forward along the line of direction of the cam surfaces 122, the upper gripping member is moved forward and downwardly to such that the pouch 15 is clamped therebetween with the flat portions of the gripping members 115, 125 in abutting relationship clamping the length of the pouch and securing a portion of the tubular member 12 behind the locking ring 30 in the recesses 118 and 128 of the gripping members. In this position the edges of the pouch to either side of the gripping members will be resting upon the members of the guide section 105 of the frame. Suitable motive means will advance the upper gripping member relative to the lower gripping member. When the two members are in abutting relationship it will advance both gripping members toward the tapered portion 106 of the guide members 105. The guide or plow plates 100 on the frame 55 when engaged by the edges of the pouch will cause the edges of the pouch to be deflected downwardly folding the same in a generally "U" shaped configuration around the lower gripping member 125 and causing the pouch to enter the confines of the shaper 90 with the upper and lower gripping members being guided by the guide rails 94, 95 respectively within the interior of the shaper. The lower track 95 of the carton shaper has positioned thereon stop sections 96, 97 which cooperate with a notched surface 99 on the lower pouch gripping member so that when the gripping members 115, 125 with the pouch thereon are directed into the carton shaper 90, the stops will cause the carton shaper to advance with continued movement of the gripping members along the recess 59 of the frame into the carton 40 itself. This movement continues until the carton shaper with the pouch gripping members 115, 125 therein and holding a pouch therebetween is advanced completely into the carton. The recesses 118, 128 in the pouch gripping members 115, 125 form a cylindrical holder for the inner end of the tubular member 12 within the pouch to direct the same through the aperture 45 in the carton. As the tubular member 12 extends through the aperture 45 in the carton the tubular member with the locking ring 30 thereon comes into alignment with the sleeve member 80 which is held in the grooved recess 62 at the end of the frame. At this point, the continued motion of the gripping members will force the tubular member 12 into the sleeve member 80 so that the sleeve member mounts on the projecting portion of the locking ring 30 to frictionally grip the same. The sleeve member has a flange 82 thereon which fits around or covers the aperture 45 in the carton and provides a clamping surface on the outside of the same, which through the frictional engagement between the projecting portions of the locking ring and sleeve member will provide a coupling between the parts. The flange portion 31 of the locking ring 30 on the tubular member 12 within the carton will bear against the interior of the carton surrounding the and the sleeve member 80 on the top wall of the carton 40 secures the pouch 15 to the carton. As seen in FIGS. 8 and 11, the sleeve member includes an internal tubular piercing section 85. As the sleeve member 80 is advanced over the tubular member it will cause the tubular piercing element formed integral therewith to advance into the interior of the tubular member 12 piercing the film across the end of the same and providing communication through the sleeve member 12 and tubular piercing section 85 to the interior of the pouch 15.

Figure 10:
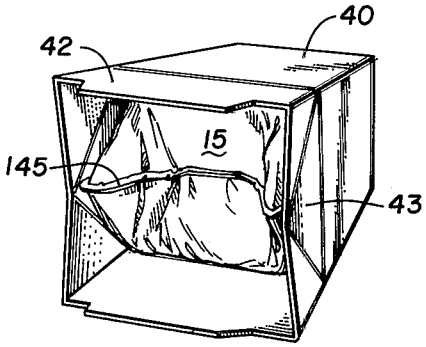
FIG. 10 is a schematic view showing the inflation of the pouch within the carton before the bottom flaps are sealed.
Figure 9:
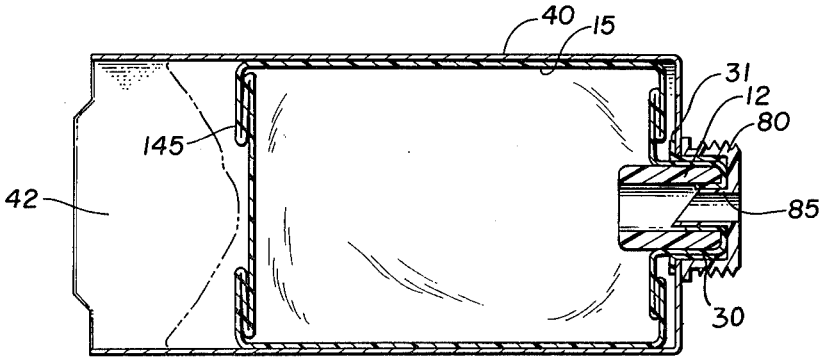
FIG. 9 is a elevation view in section of the assembled pouch and carton showing the folding of the ends of the pouch prior to folding of the flaps of the carton.

The motive means (not shown) which advances the gripping members 115, 125, together as a unit moves the pouch gripping members into the carton shaper 90 and on into the carton 40 will upon reciprocating first slightly separate the pouch gripping member 115 from the pouch gripping member 125 to release the pouch enabling the pouch gripping members to slide away from the pouch as these members are reciprocated in the opposite direction. There is a slight clearance between the upper gripping member 115 and the upper guide rail 94 within the carton shaper 90 which permits such separation. The carton shaper will be separated from the carton in this opposite direction of movement due to the cooperation of the stop 96 positioned in the track 95 and the notched surface 99 in the lower pouch gripping member 125 causing the carton shaper to be withdrawn from the carton. Prior to such separation, the carton shaper will be separated from the pouch gripping members due to the same stop configuration. When the carton shaper reaches a rest position the pouch gripping members will have moved to the opposite end of the frame. Near the extreme of movement of the pouch gripping members an upward and rearward movement of the upper pouch gripping member 115 relative to the lower pouch gripping member 125 through the camming action of the pins 130 in camming slots 122 of the guide structure 120 will separate the pouch gripping members. Thus, the pouch gripping members will be separated and in a position to receive a new pouch for a subsequent loading operation. The carton with the pouch therein will then be removed from the frame at the carton holding section 60. As shown in FIGS. 9 and 10, the container as formed by the carton and the pouch 10 therein will be then subjected to an air pressure through the sleeve member and tubular member 12 to inflate the pouch within the carton. The bottom flaps of the pouch, as indicated at 145, or the corners of the same will be folded in on the pouch itself and the lower flaps 42, 43 of the carton will then be closed and through a suitable sealing operation such as glueing or heat will seal the bottom of the carton. Thus, the container formed by the combination of the carton and pouch will normally be empty although inflated and ready for filling. Similarly, the pouch will be rigidly held by the upper end flaps of the carton and located within the carton to substantially or completely fill the same.

Figure 12:
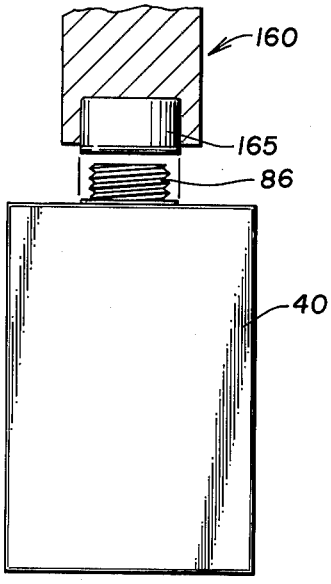
FIG. 12 is a schematic view showing the adding of a cap to seal the same.

A suitable filling operation, such as is indicated at 150, in FIG. 11, permits the cartons to be automatically filled by any conventional filling machine through the tubular member of the pouch projecting into the sleeve member and exposed on the upper surface of the carton. Once the pouch is filled with the fluid, a suitable capping operation, such as is indicated schematically in FIG. 12 at 160 will add a cap 165 to the sleeve member. The external periphery of the sleeve member as indicated at 86, is threaded and the cap 165 will be internally threaded to seal the container with the liquid therein. Thereafter the liquid may be dispensed by manually removing the cap from the threaded sleeve member and pouring the liquid from the container.

The improved container provides for a combination of a paper carton with a plastic pouch therein. The plastic film pouch has a tubular member projected at one end of the same with the plastic deformed around its end of the same and retained therein by means of locking ring 30. The pouch is formed conventionally by heat sealing the edges of the film sheet to complete the pouch and thereafter the pouch is inserted into the paper carton which has been erected to receive the same. When inserted, the pouch preferably has a "U" shaped drape with tubular member and a portion of the locking ring projecting through an aperture in the formed end wall of the carton when it is secured to the carton by means of a sleeve member frictionally positioned over the portion of the locking ring on the tubular member. The pouch is of such dimension that when inflated it will substantially fill the carton and with the corners folded will permit the bottom flaps of the carton to be sealed such that the carton may be filled through the spout and fluid dispensed therefrom in the same manner. A suitable sealing cap is added to the sleeve member which is frictionally held on the locking ring with the tubular member forming the spout.

The process of manufacturing the carton includes erecting the paper carton with the aperture through one or more end flaps of the same, holding the pouch in a manner to define a generally "U" shaped configuration and advancing it through a guide shaping member in the form of a carton to position the pouch within the carton with the tubular member and a portion of the locking ring exposed through the aperture therein. The exposed portion of the locking ring frictionally engages an external sleeve member with the flange thereon to clamp the tubular member to the carton and hence, the pouch to the carton. Inflation of the pouch with air will cause the pouch to fill the carton and permit folding of the end flaps to provide a packaging arrangement in which the carton is substantially filled with the inflated pouch so that it may receive fluid and contain the same. The use of the carton and the pouch combination minimizes the leakage possibility since the sealed pouch provides a sealed container against the leakage of the fluid and similarly, the carton surrounding the same further provides a sealed container in the event that leakage should occur through the plastic pouch. The improved container may then be readily handled, filled and sealed and provides an economical container for holding, storing and dispensing the fluids.

Figure 13:
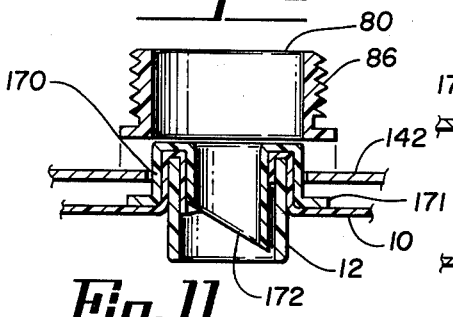
FIG. 13 is a schematic view showing an alternate embodiment of the locking ring and sleeve member mounted on the tubular member of the pouch; and, FIG. 14 is a schematic view of still another embodiment of the locking ring and sleeve member mounted on the tubular member of the pouch.

The embodiment shown schematically in FIG. 13 indicates that the locking ring 170 is positioned on the tubular member over the film and has formed integral therewith a tubular piercing member 172. A flange or projecting portion 171 of the locking ring extends translational of the tubular member the pouch on the end of the tubular member is pierced with the installation of the locking ring. The locking ring is swaged over the film to secure the same to the tubular member 12. Thus, the pouch is in effect opened prior to completion or sealing of the edges of the same and when the pouch is inserted into the paper carton, the sleeve member with its translationally extending flange telescopically and frictionally fits over the locking ring, and the flange of the locking ring cooperates with the flange portion of the sleeve member to secure the carton flap 42 therebetween. Thus, the sleeve member when installed secures the pouch to the carton in the same manner.

Figure 14:
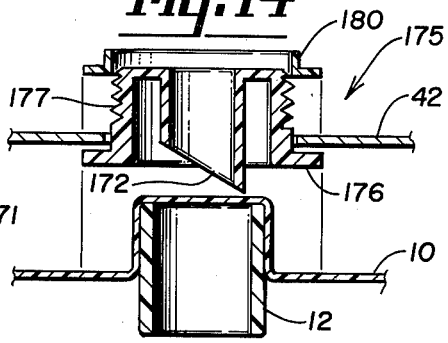

The embodiment shown in FIG. 14 shows still another embodiment of the locking ring 175 having a translationally extending or annular flange portion 176 and an integrally formed tubular piercing element 172 thereon such that the film over the end of the tubular member is pierced as the locking ring is installed and swaged on the tubular member with the film therebetween. The body of the locking ring is threaded as at 177 and the sleeve member in this embodiment is a annular ring 180 generally "L" shaped in cross section which telescopically fits over the unthreaded portion of the locking ring to frictionally grip the same and to secure the carton flap 42 therebetween upon installation in the carton. The threaded portion 176 of the locking ring serves to mount the sealing cap in this embodiment.

Thus, the improved carton includes a pouch which is fastened to the carton at the apparatus positioned in the end of the same after the carton is partially formed and the pouch is inserted therein with the carton being completed or sealed at the opposite end through which the pouch is inserted. The locking ring positioned on the tubular member within the pouch serves as the mounting for the sleeve member which secures the pouch to the end of the carton by telescopically and frictionally fitting on the portion of the locking ring which protrudes through the aperture at the end of the carton. As indicated in the various embodiments, the piercing member may be carried by the sleeve member or may be formed with the locking ring so as to be installed with the locking ring. It may also be be a separate independent part which is inserted into the tubular member and frictionally held therein during the formation of the pouch. In all embodiments, the pouch will be preferably inflated and sealed within the carton prior to filling. It will be understood, however, that the improved carton may include the positioning of a filled pouch within the carton and securing of the pouch to the carton through the variations of the locking ring and sleeve member as outlined above with the carton being sealed after the filled pouch is inserted therein.

Therefore, in considering this invention it should be remembered that the present disclosure is illustrative only and the scope of the invention, particularly as to the machine components, and the shape of the same may be varied with the scope of the appended claims.

What I claim is:

1. A container for dispensing fluid comprising, a carton having sides defining a generally rectangular cross section and a height dimension greater than the dimension of a side with a sealed bottom and top end; said carton being made of a paper material and having an aperture through the sealed top end; a flexible pouch of plastic material positioned in the carton, said pouch being formed with seamed edges defining sides and a top; a tubular member positioned through the top of the pouch with the pouch being formed around the tubular member; a locking ring positioned over the tubular member and the top of the pouch and securing the tubular member therein; a sleeve member positioned telescopically over the locking ring with the exposed end of the tubular member being open; said locking ring and tubular member being positioned through the aperture in the sealed top end of the carton with said sleeve member positioned over the aperture and cooperating with the locking ring to retain the pouch secured to the carton; and a removable cap positioned over the sleeve member to seal the pouch, said locking ring positioned over the tubular member having a flange surface within the carton and the sleeve member having a flange surface wherein said locking ring flange and said sleeve member flange combine to bear against the inside and outside surfaces of the carton, respectively and including a piercing member telescopically fitted into the tubular member to open the pouch at the end of the tubular member.

2. The container of claim 1 in which the aperture through the carton is disposed off center from the geometric center of the carton.

3. The container of claim 1 in which the pouch has sides having a width generally equal to twice the width of the sides of the carton.

4. The container of claim 1 in which the flexible pouch with the seamed edges form a generally rectangular configuration greater than the height of the carton and in which the corners of the rectangular pouch are folded.

5. The container of claim 1 in which the flexible pouch formed of a sheet of plastic material seamed at the edges has a generally rectangular configuration with the tubular element positioned centrally through an unsealed side and in which the pouch has a width and height dimension substantially equal to two sides of the carton and greater than the height of the carton.

6. The container of claim 5 in which certain of the seamed edges of the pouch are located intermediate opposing sides of the container.

7. The container of claim 1 in which the sleeve member has a threaded exterior portion and the removable cap has an interior threaded surface to mount the cap on the sleeve member to seal the opening in the pouch.

8. The container of claim 7 in which the piercing element is formed integral with the sleeve member.

9. A container for dispensing fluid comprising, a carton having sides defining a generally rectangular cross section and a height dimension greater than the dimension of a side with a sealed bottom and top end; said carton being made of a paper material and having an aperture through the sealed top end; a flexible pouch of plastic material positioned in the carton, said pouch being formed with seamed edges defining sides and a top, a tubular member positioned through the top of the pouch with the pouch being formed around the tubular member; a locking ring positioned over the tubular member and the top of the pouch and securing the tubular member therein; a sleeve member positioned telescopically over the locking ring with the exposed end of the tubular member having the pouch thereon being open; said locking ring and tubular member being positioned through the aperture in the sealed top end of the carton with said sleeve member being positioned over the aperture and cooperating with the locking ring to retain the pouch secured to the carton through the locking ring and the tubular member; and, said locking ring having an exterior threaded surface and a removable cap member, which is positioned over the sleeve member having an interior threaded surface with the cap member being mounted on the threaded portion of the locking ring to seal the opening in the pouch.

10. A container for dispensing fluid comprising, a carton having sides defining a generally rectangular cross section and a height dimension greater than the dimension of a side with a sealed bottom and top end; said carton being made of a paper material and having an aperture through the sealed top end; a flexible pouch of plastic material positioned in the carton, said pouch being formed with seamed edges defining sides and a top; a tubular member positioned through the top of the pouch with a pouch being formed around the tubular member; a locking ring positioned over the tubular member and the top of the pouch and securing the tubular member therein; a sleeve member positioned telescopically over the locking ring with the exposed end of the tubular member being open; said locking ring being positioned through the aperture in the sealed top end of the carton with said sleeve member being positioned over the aperture and cooperating with the locking ring to retain the pouch secured to the carton; a removable cap positioned over the sleeve member to seal the pouch; and including a piercing element telescopically fitted into the tubular member to open the pouch at the end of the tubular member, said piercing element being formed integral with the locking ring.

* * * * *